US008316964B2

(12) United States Patent
Hall et al.

(10) Patent No.: US 8,316,964 B2
(45) **Date of Patent: *Nov. 27, 2012**

(54) DRILL BIT TRANSDUCER DEVICE

(75) Inventors: David R. Hall, Provo, UT (US); Christopher Durrand, Pleasant Grove, UT (US); Paula Turner, Pleasant Grove, UT (US); Daryl Wise, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 1146 days.

This patent is subject to a terminal disclaimer.

(21) Appl. No.: 11/761,095

(22) Filed: Jun. 11, 2007

(65) Prior Publication Data

US 2007/0229232 A1 Oct. 4, 2007

Related U.S. Application Data

(63) Continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, which is a continuation-in-part of application No. 11/278,935, filed on Apr. 6, 2006, now Pat. No. 7,426,968, which is a continuation-in-part of application No. 11/277,294, filed on Mar. 23, 2006, which is a continuation-in-part of application No. 11/277,380, filed on Mar. 24, 2006.

(51) Int. Cl.
*E21B 47/00* (2012.01)
*E21B 49/00* (2006.01)

(52) U.S. Cl. ..... 175/40; 175/50

(58) Field of Classification Search ..... 175/40, 175/50; 340/384.73

See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 923,513 | A | 6/1909 | Hardsocg |
| 946,060 | A | 1/1910 | Looker |
| 1,116,154 | A | 11/1914 | Stowers |
| 1,183,630 | A | 5/1916 | Bryson |

(Continued)

OTHER PUBLICATIONS

Patent Cooperation Treaty, International Search Report and Written Opinion of the International Searching Authority for PCT/US07/64544, date of mailing Aug. 5, 2008.

(Continued)

*Primary Examiner* — William P Neuder
(74) *Attorney, Agent, or Firm* — Osha Liang LLP

(57) ABSTRACT

In one aspect of the present invention, a drill bit assembly has a body intermediate a shank and a working face. The working face has at least one cutting element. The drill bit also has a jack element with a distal end substantially protruding from the working face and at least one downhole material driven transducer in communication with the jack element.

29 Claims, 11 Drawing Sheets

U.S. PATENT DOCUMENTS

| | | | | |
|---|---|---|---|---|
| 1,189,560 | A | | 7/1916 | Gondos |
| 1,360,908 | A | | 11/1920 | Everson |
| 1,372,257 | A | | 3/1921 | Swisher |
| 1,387,733 | A | | 8/1921 | Midgett |
| 1,460,671 | A | | 7/1923 | Hebsacker |
| 1,544,757 | A | | 7/1925 | Hufford |
| 1,746,455 | A | | 2/1930 | Woodruff et al. |
| 1,746,456 | A | | 2/1930 | Allington |
| 2,169,223 | A | | 8/1931 | Christian |
| 1,821,474 | A | | 9/1931 | Mercer |
| 1,836,638 | A | | 12/1931 | Wright et al. |
| 1,879,177 | A | | 9/1932 | Gault |
| 2,054,255 | A | | 9/1936 | Howard |
| 2,064,255 | A | | 12/1936 | Garfield |
| 2,196,940 | A | | 4/1940 | Potts |
| 2,218,130 | A | | 10/1940 | Court |
| 2,227,233 | A | | 12/1940 | Scott et al. |
| 2,300,016 | A | | 10/1942 | Scott et al. |
| 2,320,136 | A | | 5/1943 | Kammerer |
| 2,345,024 | A | | 3/1944 | Bannister |
| 2,371,248 | A | | 3/1945 | McNamara |
| 2,466,991 | A | | 4/1949 | Kammerer |
| 2,498,192 | A | | 2/1950 | Wright |
| 2,540,464 | A | | 2/1951 | Stokes |
| 2,544,036 | A | | 3/1951 | Kammerer |
| 2,575,173 | A | | 11/1951 | Johnson |
| 2,619,325 | A | | 1/1952 | Arutunoff |
| 2,626,780 | A | | 1/1953 | Ortloff |
| 2,643,860 | A | | 6/1953 | Koch |
| 2,725,215 | A | | 11/1955 | Macneir |
| 2,735,653 | A | | 2/1956 | Bielstein |
| 2,755,071 | A | | 7/1956 | Kammerer |
| 2,776,819 | A | | 1/1957 | Brown |
| 2,819,041 | A | | 1/1958 | Beckham |
| 2,819,043 | A | | 1/1958 | Henderson |
| 2,838,284 | A | | 6/1958 | Austin |
| 2,873,093 | A | | 2/1959 | Hildebrandt et al. |
| 2,877,984 | A | | 3/1959 | Causey |
| 2,894,722 | A | | 7/1959 | Buttolph |
| 2,901,223 | A | | 8/1959 | Scott |
| 2,942,850 | A | | 6/1960 | Heath |
| 2,963,102 | A | | 12/1960 | Smith |
| 2,998,085 | A | | 8/1961 | Dulaney |
| 3,036,645 | A | | 5/1962 | Rowley |
| 3,055,443 | A | | 9/1962 | Edwards |
| 3,058,532 | A | * | 10/1962 | Alder ..... 175/39 |
| 3,075,592 | A | | 1/1963 | Overly et al. |
| 3,077,936 | A | | 2/1963 | Arutunoff |
| 3,135,341 | A | | 6/1964 | Ritter |
| 3,139,147 | A | * | 6/1964 | Hays et al. ..... 175/233 |
| 3,163,243 | A | | 12/1964 | Cleary |
| 3,216,514 | A | | 11/1965 | Nelson |
| 3,251,424 | A | | 5/1966 | Brooks |
| 3,294,186 | A | | 12/1966 | Buell |
| 3,301,339 | A | | 1/1967 | Pennebaker |
| 3,303,899 | A | | 2/1967 | Jones et al. |
| 3,336,988 | A | | 8/1967 | Jones |
| 3,379,264 | A | | 4/1968 | Cox |
| 3,429,390 | A | | 2/1969 | Bennett |
| 3,433,331 | A | | 3/1969 | Heyberger |
| 3,455,158 | A | * | 7/1969 | Richter, Jr. et al. ..... 73/152.03 |
| 3,493,165 | A | | 2/1970 | Schonfeld |
| 3,583,504 | A | | 6/1971 | Aalund |
| 3,635,296 | A | | 1/1972 | Lebourg |
| 3,700,049 | A | | 10/1972 | Tiraspolsky et al. |
| 3,732,143 | A | | 5/1973 | Joosse |
| 3,764,493 | A | | 10/1973 | Rosar |
| 3,807,512 | A | | 4/1974 | Pogonowski et al. |
| 3,815,692 | A | | 6/1974 | Varley |
| 3,821,993 | A | | 7/1974 | Kniff |
| 3,899,033 | A | | 8/1975 | Huisen |
| 3,955,635 | A | | 5/1976 | Skidmore |
| 3,960,223 | A | | 6/1976 | Kleine |
| 3,978,931 | A | | 9/1976 | Sudnishnikov et al. |
| 4,081,042 | A | | 3/1978 | Johnson |
| 4,096,917 | A | | 6/1978 | Harris |
| 4,106,577 | A | | 8/1978 | Summers |
| 4,165,790 | A | | 8/1979 | Emmerich |
| 4,176,723 | A | | 12/1979 | Arceneaux |
| 4,253,533 | A | | 3/1981 | Baker |
| 4,262,758 | A | | 4/1981 | Evans |
| 4,280,573 | A | | 7/1981 | Sudnishnikov |
| 4,304,312 | A | | 12/1981 | Larsson |
| 4,307,786 | A | | 12/1981 | Evans |
| 4,386,669 | A | | 6/1983 | Evans |
| 4,397,361 | A | | 8/1983 | Langford |
| 4,416,339 | A | | 11/1983 | Baker |
| 4,445,580 | A | | 5/1984 | Sahley |
| 4,448,269 | A | | 5/1984 | Ishikawa |
| 4,478,296 | A | | 10/1984 | Richman |
| 4,499,795 | A | | 2/1985 | Radtke |
| 4,531,592 | A | | 7/1985 | Hayatdavoudi |
| 4,535,853 | A | | 8/1985 | Ippolito |
| 4,538,691 | A | | 9/1985 | Dennis |
| 4,566,545 | A | | 1/1986 | Story |
| 4,574,895 | A | | 3/1986 | Dolezal |
| 4,583,592 | A | | 4/1986 | Gazda et al. |
| 4,592,432 | A | | 6/1986 | Williams et al. |
| 4,597,454 | A | | 7/1986 | Schoeffler |
| 4,612,987 | A | | 9/1986 | Cheek |
| 4,624,306 | A | | 11/1986 | Traver et al. |
| 4,637,479 | A | | 1/1987 | Leising |
| 4,640,374 | A | | 2/1987 | Dennis |
| 4,679,637 | A | | 7/1987 | Cherrington |
| 4,683,781 | A | | 8/1987 | Kar et al. |
| 4,732,223 | A | | 3/1988 | Schoeffler |
| 4,775,017 | A | | 10/1988 | Forrest et al. |
| 4,819,745 | A | | 4/1989 | Walter |
| 4,830,122 | A | | 5/1989 | Walter |
| 4,836,301 | A | | 6/1989 | Van Dongen et al. |
| 4,852,672 | A | | 8/1989 | Behrens |
| 4,889,017 | A | | 12/1989 | Fuller |
| 4,907,665 | A | | 3/1990 | Kar et al. |
| 4,962,822 | A | | 10/1990 | Pascale |
| 4,974,688 | A | | 12/1990 | Helton |
| 4,981,184 | A | | 1/1991 | Knowlton |
| 4,991,667 | A | | 2/1991 | Wilkes et al. |
| 5,009,273 | A | | 4/1991 | Grabinski |
| 5,027,914 | A | | 7/1991 | Wilson |
| 5,038,873 | A | | 8/1991 | Jurgens |
| 5,052,503 | A | | 10/1991 | Lof |
| 5,088,568 | A | | 2/1992 | Simuni |
| 5,094,304 | A | | 3/1992 | Briggs |
| 5,103,919 | A | | 4/1992 | Warren et al. |
| 5,119,892 | A | | 6/1992 | Clegg |
| 5,135,060 | A | | 8/1992 | Ide |
| 5,141,063 | A | | 8/1992 | Quesenbury |
| 5,148,875 | A | | 9/1992 | Karlsson et al. |
| 5,163,520 | A | | 11/1992 | Gibson et al. |
| 5,176,212 | A | | 1/1993 | Tandberg |
| 5,186,268 | A | | 2/1993 | Clegg |
| 5,222,566 | A | | 6/1993 | Taylor |
| 5,255,749 | A | | 10/1993 | Bumpurs |
| 5,259,469 | A | | 11/1993 | Stjernstrom et al. |
| 5,265,682 | A | | 11/1993 | Russell |
| 5,311,953 | A | | 5/1994 | Walker |
| 5,314,030 | A | | 5/1994 | Peterson et al. |
| 5,361,859 | A | | 11/1994 | Tibbitts |
| 5,388,649 | A | | 2/1995 | Ilomaki |
| 5,410,303 | A | | 4/1995 | Comeau |
| 5,415,030 | A | | 5/1995 | Jogi et al. |
| 5,417,292 | A | | 5/1995 | Polakoff |
| 5,423,389 | A | | 6/1995 | Warren |
| 5,475,309 | A | | 12/1995 | Hong et al. |
| 5,507,357 | A | | 4/1996 | Hult |
| 5,553,678 | A | | 9/1996 | Barr et al. |
| 5,560,440 | A | | 10/1996 | Tibbitts |
| 5,568,838 | A | | 10/1996 | Struthers |
| 5,642,782 | A | | 7/1997 | Grimshaw |
| 5,655,614 | A | | 8/1997 | Azar |
| 5,678,644 | A | | 10/1997 | Fielder |
| 5,720,355 | A | | 2/1998 | Lamine et al. |
| 5,732,784 | A | | 3/1998 | Nelson |
| 5,758,731 | A | | 6/1998 | Zollinger |
| 5,778,991 | A | | 7/1998 | Runquist et al. |
| 5,794,728 | A | | 8/1998 | Palmberg |
| 5,806,611 | A | | 9/1998 | Van Den Steen |

5,833,021 A 11/1998 Mensa-Wilmot et al.
5,864,058 A 1/1999 Chen
5,896,938 A 4/1999 Moeny
5,901,113 A * 5/1999 Masak et al. ..... 367/57
5,904,444 A 5/1999 Kabeuchi et al.
5,924,499 A 7/1999 Birchak et al.
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,047,239 A 4/2000 Berger et al.
6,050,350 A 4/2000 Morris et al.
6,089,332 A 7/2000 Barr et al.
6,092,610 A 7/2000 Kosmala et al.
6,131,675 A 10/2000 Anderson
6,150,822 A * 11/2000 Hong et al. ..... 324/338
6,186,251 B1 2/2001 Butcher
6,202,761 B1 3/2001 Forney
6,213,225 B1 4/2001 Chen
6,213,226 B1 4/2001 Eppink
6,223,824 B1 5/2001 Moyes
6,269,893 B1 8/2001 Beaton
6,296,069 B1 10/2001 Lamine
6,298,930 B1 10/2001 Sinor
6,321,858 B1 11/2001 Wentworth et al.
6,340,064 B2 1/2002 Fielder
6,363,780 B1 4/2002 Rey-Fabret
6,364,034 B1 4/2002 Schoeffler
6,364,038 B1 4/2002 Driver
6,394,200 B1 5/2002 Watson
6,439,326 B1 8/2002 Huang
6,443,249 B2 9/2002 Beuershausen
6,450,269 B1 9/2002 Wentworth et al.
6,454,030 B1 9/2002 Findley et al.
6,466,513 B1 10/2002 Pabon et al.
6,467,341 B1 10/2002 Boucher et al.
6,474,425 B1 11/2002 Truax
6,484,819 B1 11/2002 Harrison
6,484,825 B2 11/2002 Watson
6,510,906 B1 1/2003 Richert
6,513,606 B1 2/2003 Krueger
6,533,050 B2 3/2003 Malloy
6,575,236 B1 6/2003 Heijnen
6,581,699 B1 6/2003 Chen et al.
6,588,518 B2 7/2003 Eddison
6,594,881 B2 7/2003 Tibbitts
6,601,454 B1 8/2003 Bolnan
6,622,803 B2 9/2003 Harvey
6,668,949 B1 12/2003 Rives
6,670,880 B1 12/2003 Hall et al.
6,675,914 B2 * 1/2004 Masak ..... 175/48
6,729,420 B2 5/2004 Mensa-Wilmot
6,732,817 B2 5/2004 Dewey
6,749,031 B2 6/2004 Klemm
6,789,635 B2 9/2004 Wentworth et al.
6,814,162 B2 11/2004 Moran et al.
6,822,579 B2 11/2004 Goswami
6,880,648 B2 4/2005 Edscer
6,913,095 B2 7/2005 Krueger
6,929,076 B2 8/2005 Fanuel
6,948,572 B2 9/2005 Hay et al.
6,953,096 B2 10/2005 Gledhill
6,994,175 B2 2/2006 Egerstrom
7,013,994 B2 3/2006 Eddison
7,073,610 B2 7/2006 Susman
7,198,119 B1 4/2007 Hall et al.
7,225,886 B1 6/2007 Hall
7,270,196 B2 9/2007 Hall
7,328,755 B2 2/2008 Hall et al.
7,337,858 B2 3/2008 Hall et al.
7,350,568 B2 * 4/2008 Mandal et al. ..... 166/254.2
7,360,610 B2 4/2008 Hall et al.
7,367,397 B2 5/2008 Clemens et al.
7,398,837 B2 * 7/2008 Hall et al. ..... 175/50
7,419,016 B2 9/2008 Hall et al.
7,419,018 B2 9/2008 Hall et al.
7,424,922 B2 9/2008 Hall et al.
7,426,968 B2 9/2008 Hall et al.
7,481,281 B2 1/2009 Schuaf
7,484,576 B2 2/2009 Hall et al.
7,497,279 B2 3/2009 Hall et al.
7,503,405 B2 3/2009 Hall et al.
7,506,701 B2 3/2009 Hall et al.
7,510,031 B2 3/2009 Russell et al.
7,549,489 B2 6/2009 Hall et al.
7,559,379 B2 7/2009 Hall et al.
7,600,586 B2 10/2009 Hall et al.
7,617,886 B2 11/2009 Hall
7,624,824 B2 12/2009 Hall et al.
7,641,003 B2 1/2010 Hall et al.
2001/0054515 A1 12/2001 Eddison et al.
2002/0050359 A1 5/2002 Eddison
2003/0213621 A1 11/2003 Britten
2004/0222024 A1 11/2004 Edscer
2004/0238221 A1 12/2004 Runia
2004/0256155 A1 12/2004 Kriesels
2007/0079988 A1 4/2007 Konschuh et al.

OTHER PUBLICATIONS

Paten Cooperation Treaty, International Preliminary Report on Patentability, International Search Report and Written Opinion of the International Searching Authority for PCT/US06/43107, date of mailing Mar. 5, 2007.

Paten Cooperation Treaty, International Preliminary Report on Patentability and Written Opinion of the International Searching Authority for PCT/US06/43125, date of mailing Jun. 4, 2007; and the International Search Report, dated Feb. 23, 2007.

* cited by examiner

DRILL BIT TRANSDUCER DEVICE

CROSS REFERENCE TO RELATED APPLICATIONS

This Patent application is a continuation-in-part of U.S. patent application Ser. No. 11/750,700 filed on May 18, 2007 and entitled Jack Element With A Stop-off that issued as U.S. Pat. No. 7,549,489 to Hall et al. on Jun. 23, 2009. U.S. patent application Ser. No. 11/750,700 is a continuation-in-part of U.S. patent application Ser. No. 11/737,034 filed on Apr. 18, 2007 and entitled Rotary Valve For Steering A Drill Bit that issued as U.S. Pat. No. 7,503,405 to Hall et al., on May 17, 2009. U.S. patent application Ser. No. 11/737,034 is a continuation-in-part of U.S. patent application Ser. No. 11/686,638 filed on Mar. 15, 2007 and entitled Rotary Valve For A Jack Hammer that issued as U.S. Pat. No. 7,424,922 to Hall et al. on Sep. 16, 2008. U.S. patent application Ser. No. 11/686,638 is a continuation-in-part of U.S. patent application Ser. No. 11/680,997 filed on Mar. 1, 2007 and entitled Bi-center Drill Bit that issued as U.S. Pat. No. 7,419,016 to Hall et al., on Sep. 2, 2008. U.S. patent application Ser. No. 11/680,997 is a continuation-in-part of U.S. patent application Ser. No. 11/673,872 filed on Feb. 12, 2007 and entitled Jack Element In Communication With An Electric Motor and/or Generator that issued as U.S. Pat. No. 7,484,576 to Hall et al., on Feb. 3, 2009. U.S. patent application Ser. No. 11/673,872 is a continuation-in-part of U.S. patent application Ser. No. 11/611,310 filed on Dec. 15, 2006 and entitled System For Steering A Drill String that issued as U.S. Pat. No. 7,600,586 to Hall et al., on Oct. 13, 2009. This Patent Application is also a continuation-in-part of U.S. patent application Ser. No. 11/278,935 filed on Apr. 6, 2006 and entitled Drill Bit Assembly With A Probe that issued as U.S. Pat. No. 7,426,968 to Hall et al., on Sep. 23, 2008. U.S. patent application Ser. No. 11/278,935 is a continuation-in-part of U.S. patent application Ser. No. 11/277,394 filed on Mar. 24, 2006 and entitled Drill Bit Assembly With A Logging Device that issued as U.S. Pat. No. 7,398,837 to Hall et al., on Jul. 15, 2008. U.S. patent application Ser. No. 11/277,394 is a continuation-in-part of U.S. patent application Ser. No. 11/277,380 also filed on Mar. 24, 2006 and entitled A Drill Bit Assembly Adapted To Provide Power Downhole that issued as U.S. Pat. No. 7,337,858 to Hall et al. on Mar. 4, 2008. U.S. patent application Ser. No. 11/277,380 is a continuation-in-part of U.S. patent application Ser. No. 11/306,976 filed on Jan. 18, 2006 and entitled-Drill Bit Assembly For Directional Drilling that issued as U.S. Pat. No. 7,360,610 to Hall et al., on Apr. 22, 2008. U.S. patent application Ser. No. 11/306,976 is a continuation-in-part of 11/306,307 filed on Dec. 22, 2005 and entitled Drill Bit Assembly With An Indenting Member that issued as U.S. Pat. No. 7,225,886 to Hall on Jun. 5, 2007. U.S. patent application Ser. No. 11/306,307 is a continuation-in-part of U.S. patent application Ser. No. 11/306,022 filed on Dec. 14, 2005 and entitled Hydraulic Drill Bit Assembly that issued as U.S. Pat. No. 7,198,119 to Hall et al., on Apr. 3, 2007. U.S. patent application Ser. No. 11/306,022 is a continuation-in-part of U.S. patent application Ser. No. 11/164,391 filed on Nov. 21, 2005, and entitled Drill Bit Assembly that issued as U.S. Pat. No. 7,270,196 to Hall on Sep. 18, 2007. All of these applications are herein incorporated by reference in their entirety.

BACKGROUND OF THE INVENTION

The present invention relates to the field of downhole oil, gas, and/or geothermal drilling and more particularly, to apparatus and methods for retrieving downhole data. Smart materials, such as piezoelectric and magnetostrictive materials, may be used as sensors and/or actuators downhole for measuring properties of a downhole formation such as density and porosity as well as increase the rate of penetration. The prior art contains references to drill bits with sensors or other apparatus for data retrieval.

U.S. Pat. No. 6,909,666 to Dubinsky, et al, which is herein incorporated by reference for all that it contains, discloses an acoustic logging apparatus having a drill collar conveyed on a drilling tubular in a borehole within a formation. At least one transmitter is disposed in the drill collar. The transmitter includes at least one magnetostrictive actuator cooperatively coupled by a flexure ring to a piston for converting a magnetostrictive actuator displacement into a related piston displacement for transmitting an acoustic signal in the formation.

U.S. Pat. No. 6,478,090 to Deaton, which is herein incorporated by reference for all that it contains, discloses an apparatus and method of operating devices (such as devices in a wellbore or other types of devices) utilizing actuators having expandable or contractable elements. Such expandable or contrastable elements may include piezoelectric elements, magnetostrictive elements, and heat-expandable elements. Piezoelectric elements are expandable by application of an electrical voltage; magnetostrictive elements are expandable by application of a magnetic field (which may be generated by a solenoid in response to electrical power); and heat-expandable elements are expandable by heat energy (e.g., infrared energy or microwave energy). Expandable elements are abutted to an operator member such that when the expandable element expands, the operator member is moved in a first direction, and when the expandable element contracts, the operator member moves in an opposite direction.

U.S. Pat. No. 6,814,162 to Moran, et al, which is herein incorporated by reference for all that it contains, discloses a drill bit, comprising a bit body, a sensor disposed in the bit body, a single journal removably mounted to the bit body, and a roller cone rotatably mounted to the single journal. The drill bit may also comprise a short-hop telemetry transmission device adapted to transmit data from the sensor to a measurement-while-drilling device located above the drill bit on the tool string.

BRIEF SUMMARY OF THE INVENTION

In one aspect of the present invention, a drill bit assembly has a body intermediate a shank and a working face. The working face has at least one cutting element. The drill bit also has a jack element with a distal end substantially protruding from the working face and at least one downhole material driven transducer in communication with the jack element.

In some embodiments, the material driven transducer may be a piezoelectric device. The piezoelectric device may comprise a material selected from the group consisting of quartz, barium titanate, lead zirconate titanate, lead niobate, polyvinyliene fluoride, gallium orthophosphate, tourmaline, zinc oxide, aluminum nitride, or a combination thereof. In other embodiments, the material driven transducer is a magnetostrictive device. The magnetostrictive device may comprise Terfenol-D or Galfenol. The material driven transducer may be rotationally isolated from the jack element or the drill bit body.

The transducer may be positioned intermediate a proximal end of the jack element or may be disposed on the jack element. A strain gauge and/or accelerometer may also be in communication with the jack element. The distal end of the jack element may have an asymmetric geometry that may be beneficial in steering the drill bit. The transducer may be in communication with a power source and may be adapted to vibrate the jack element. In some embodiments, the power source may supply AC power to the transducer. A spring mechanism may be disposed in a bore of the drill bit that is adapted to engage the jack element. In some embodiments, any mechanism may be used to vibrate the jack element and the transducer may be used to sense the vibrations from either the vibrating mechanism and/or reflections from the formation. In some embodiments, the act of drilling may vibrate the jack element which may be sensed by the material driven transducer and then analyzed.

In another aspect of the invention, a method has steps for retrieving downhole data. A drill bit assembly on the end of a tool string may have a body intermediate a shank and a working face. A jack element may have a distal end substantially protruding from the working face and may be in communication with at least one material driven transducer. The drill bit assembly may be deployed in a well bore such that the jack element is in communication with a subterranean formation ahead of the drill bit. Data from the transducer may be relayed to control equipment, such as sampling or sensing devices, associated with the tool string. The data inputs or outputs of the transducer may then be analyzed and adjustments may be made to the drilling operation. The method may also include a step of inducing at least one acoustic signal generated by the transducer and transmitted through the jack element into the formation The acoustic signal may reverberate off a formation and return to the drill bit assembly. The acoustic signal may have multiple frequencies and may be received by acoustic receivers located at the drill bit assembly, tool string, or earth surface. The acoustic receivers may be in communication with downhole and/or surface control equipment; the control equipment may have a closed loop system. The control equipment may also be in communication with the material driven transducer through an electrically conductive medium connected to the drill bit assembly. The electrically conductive medium may be a coaxial cable, wire, twisted pair of wires, or combinations thereof. In some embodiments, the material driver transducer may be in communication with the control equipment through mud-pulse telemetry, radio waves, short hop, or other forms of wireless communication.

Vibrations in the subterranean formation may be transmitted to the material driven transducer through the jack element. The vibrations may be produced from the drill bit assembly, the surface, or an adjacent well bore. It is believed that vibrating the drill bit assembly may also increase the drilling efficiency.

DETAILED DESCRIPTION OF THE INVENTION AND THE PREFERRED EMBODIMENT

Figure 1:
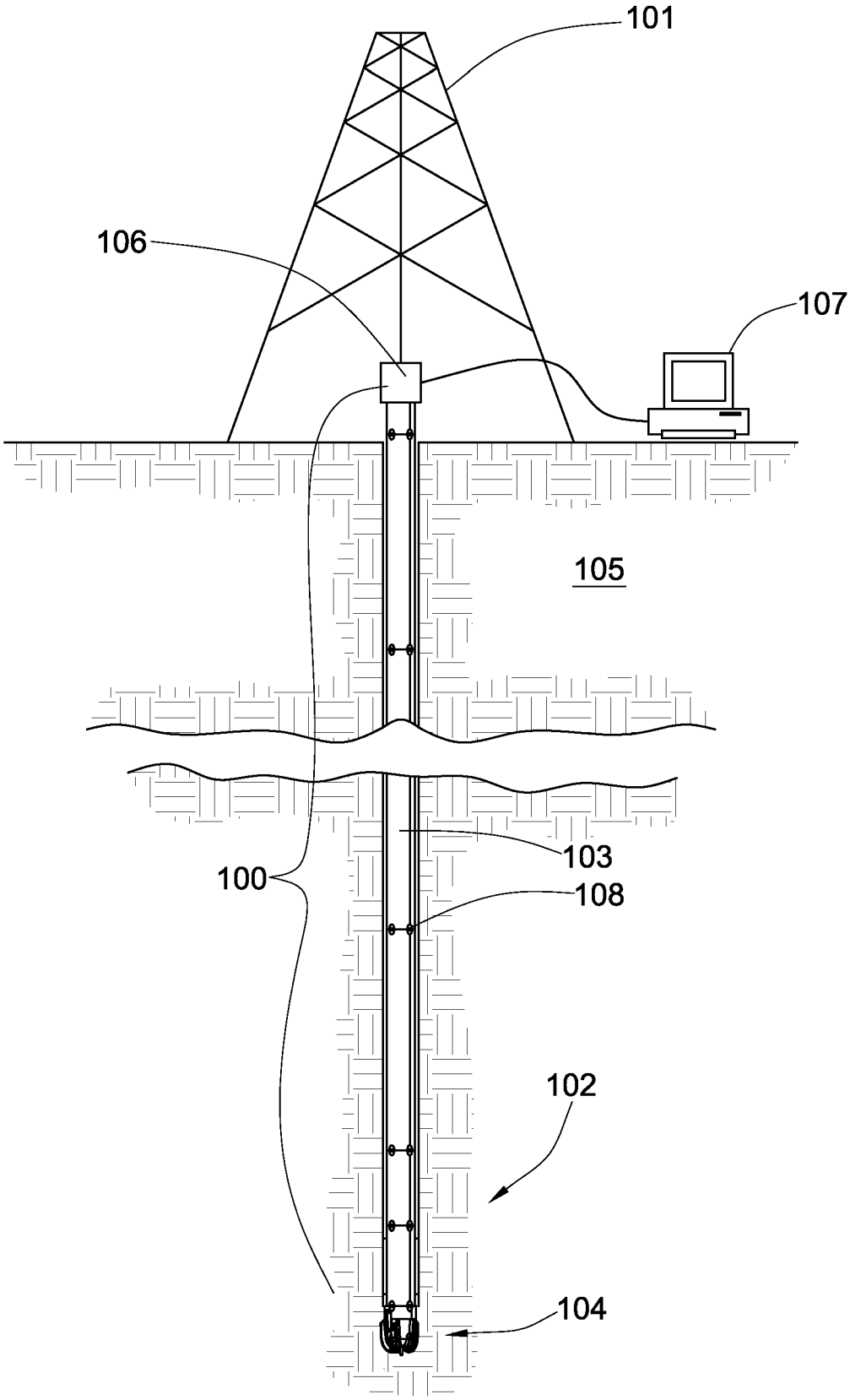
FIG. 1 is a perspective diagram of an embodiment of a tool string suspended in a well bore.

FIG. 1 shows a perspective diagram of a downhole tool string 100 suspended by a derrick 101. A bottom-hole assembly 102 is located at the bottom of a well bore 103 and comprises a drill bit assembly 104. As the drill bit 104 rotates downhole the tool string 100 advances farther into the earth. The tool string may penetrate soft or hard subterranean formations 105. The bottom hole assembly 102 and/or downhole components may comprise data acquisition devices which may gather data. The data may be sent to the surface via a transmission system to a data swivel 106. The data swivel 106 may send the data to surface control equipment 107. Further, the surface control equipment 107 may send data and/or power to downhole tools and/or the bottom-hole assembly 102. One method of downhole data transmission uses inductive couplers 108. U.S. Pat. No. 6,670,880 to Hall which is herein incorporated by reference for all that it contains, discloses a telemetry system that may be compatible with the present invention; however, other forms of telemetry may also be compatible such as systems that include wired pipe, mud pulse systems, electromagnetic waves, radio waves, and/or short hop. In some embodiments, no telemetry system is incorporated into the tool string.

Figure 2:
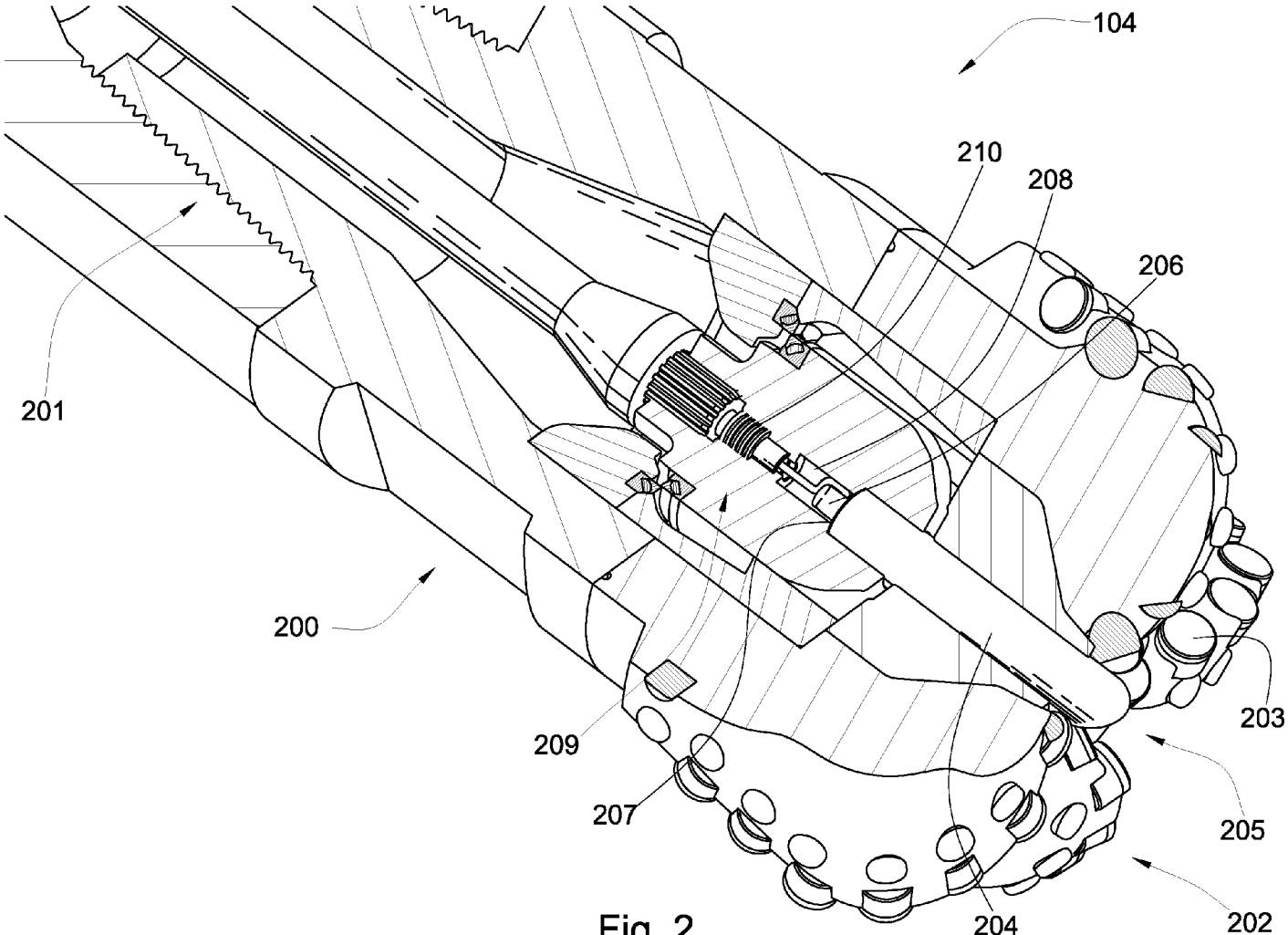
FIG. 2 is a cross-sectional diagram of an embodiment of a drill bit assembly.

FIG. 2 is a perspective diagram of a drill bit assembly 104 having a body 200 intermediate a shank 201 and a working face 202 with at least one cutting element 203. A jack element 204 may have a distal end 205 substantially protruding from the working face 202. A material driven transducer 206 may be in communication with the jack element 204. In the preferred embodiment, the transducer 206 may be a piezoelectric device. The piezoelectric device may comprise a material selected from the group consisting of quartz, barium titanate, lead zirconate titanate (PZT), lead niobate, polyvinylide fluoride, gallium, orthophosphate, tourmaline, zinc oxide, aluminum nitride, or a combination thereof.

In the preferred embodiment, the transducer 206 may be positioned intermediate a proximal end 207 of the jack element 204 and the shank 201. A strain gauge 208 and/or accelerometer may also be in communication with the jack element 204. The strain gauge 208 may be positioned such that the strain gauge 208 may measure the deformation of the transducer 206 or the jack element in response to a strain or pressure applied to the transducer 206. A seal 209 may be positioned intermediate the transducer 206 and the shank 201, the seal 209 being adapted to inhibit fluid flow through to the transducer 206 as well as maintain a high pressure within the assembly. In this embodiment, the seal 209 may comprise an O-ring stack 210.

Figure 3:
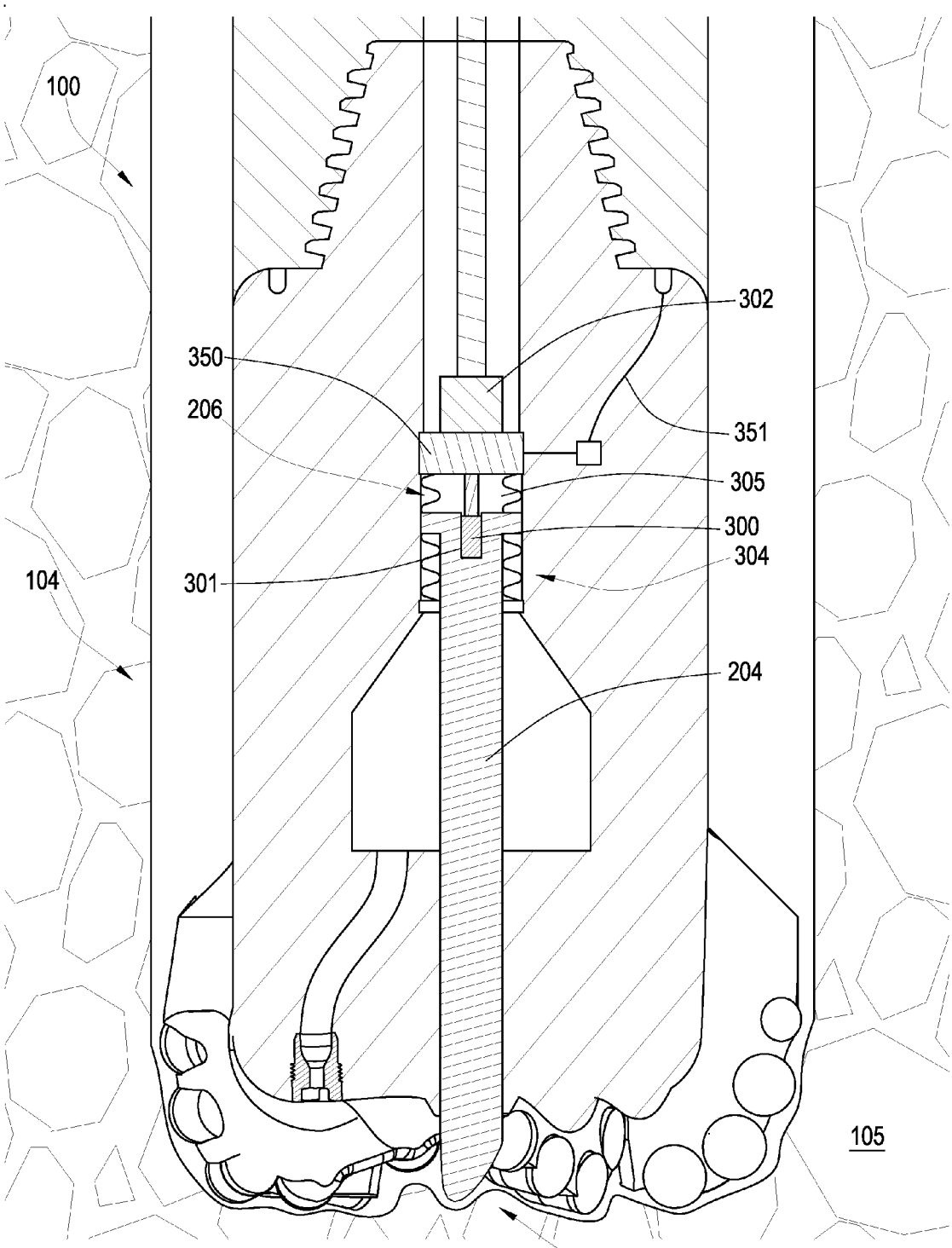
FIG. 3 is a cross-sectional diagram of another embodiment of a drill bit assembly.

Now referring to FIG. 3, at least a portion 300 of the transducer 206 may be disposed within the jack element 204. A pocket 301 formed in the jack element 204 may be adapted to receive the transducer 206. The transducer 206 may be in communication with a power source 302 and may be adapted to vibrate the jack element 204. The transducer 206 in this embodiment may be a piezoelectric device. As the power source 302 supplies voltage to the piezoelectric device, the piezoelectric device may respond to the voltage by expanding, thereby displacing the jack element 204 into the formation 105. In this embodiment, the power source may be a motor which drives a generator. The power source 302 may supply AC power to the transducer 206. Supplying AC power may be beneficial as it may cause the transducer 206 to repeatedly expand and contract with the voltages, thus vibrating the jack element 204. It is believed that vibrating the jack element 204 may increase the rate of penetration in a downhole drilling operation The vibrations of the jack element 204 may better break up the formation 105 than if the jack element 204 were not to vibrate. By vibrating the jack element 204, acoustic signals may be transmitted from the jack element 204 into the formation 105. The acoustic signals may reflect off the formation 105 and may be received by acoustic receivers located on the drill bit assembly 104, the tool string 100, or at the surface.

A thrust bearing 350 may be positioned intermediate the transducer 206 and the power source 302, the thrust bearing 350 being adapted to resist the transducer 206 as the transducer responds to mechanical strain from the jack element 204. The thrust bearing 350 may also allow the tool string 100 and the jack element 204 to rotate independently of each other. The thrust bearing 350 may provide means for communication between the transducer 206 and control equipment. Current may be sent from the control equipment through an electrically conductive medium 351. The distal end 205 of the jack element 204 may have an asymmetric geometry. The asymmetric distal end 205 may be used for steering the tool string 100.

A spring mechanism 304 may be disposed in a bore 305 of the drill bit assembly 104, the spring mechanism being adapted to engage the jack element 204. The spring mechanism 304 may regulate the vibrations of the jack element 204 as the transducer 206 expands and compresses, actuating the jack element 204.

Figure 4:
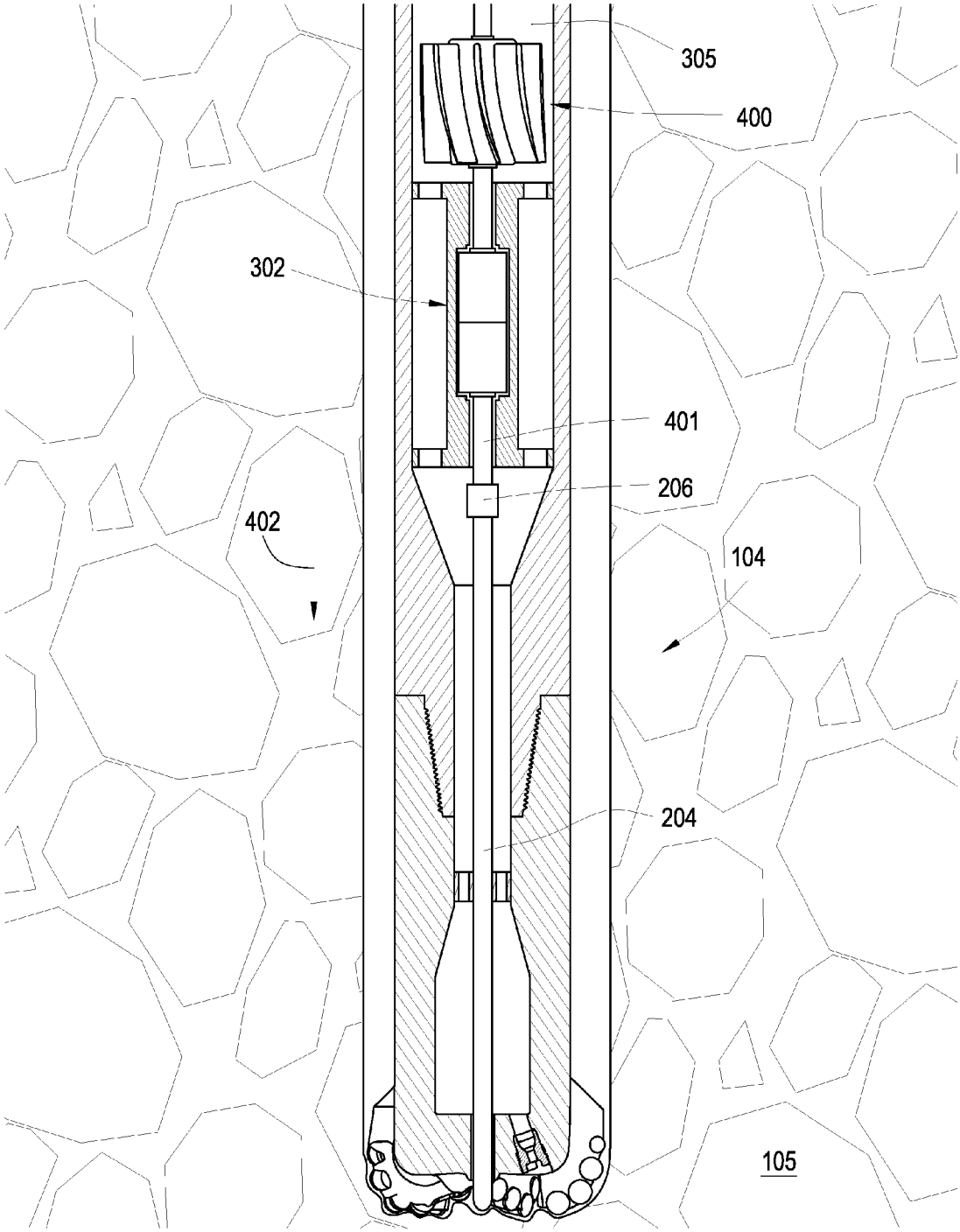
FIG. 4 is a cross-sectional diagram of another embodiment of a drill bit assembly.

FIG. 4 is a cross-sectional diagram of a drill bit assembly 104 having a transducer 206 disposed between the jack element 204 and a power source 302. In this embodiment, the power source 302 may be an electric generator actuated by a turbine 400. Drilling fluid passing through the bore 305 of the drill bit assembly 104 may actuate the turbine, and in doing so, actuate the power source 302. The electric generator may supply voltage to the transducer 206, causing the transducer to expand, thereby displacing the jack element 204. A rotor 401 may restrict the transducer 206 from expanding in a direction opposite the jack element 204 such that the transducer 206 may only expand in a direction 402 toward the jack element 204, forcing the jack element 204 to displace into the formation 105. In some embodiments, short pulses are used to drive the material driven transducer with enough time between the pulses to allow the reflections in front of the bit generated from the pulses to be sensed by the material driven transducer.

Figure 5:
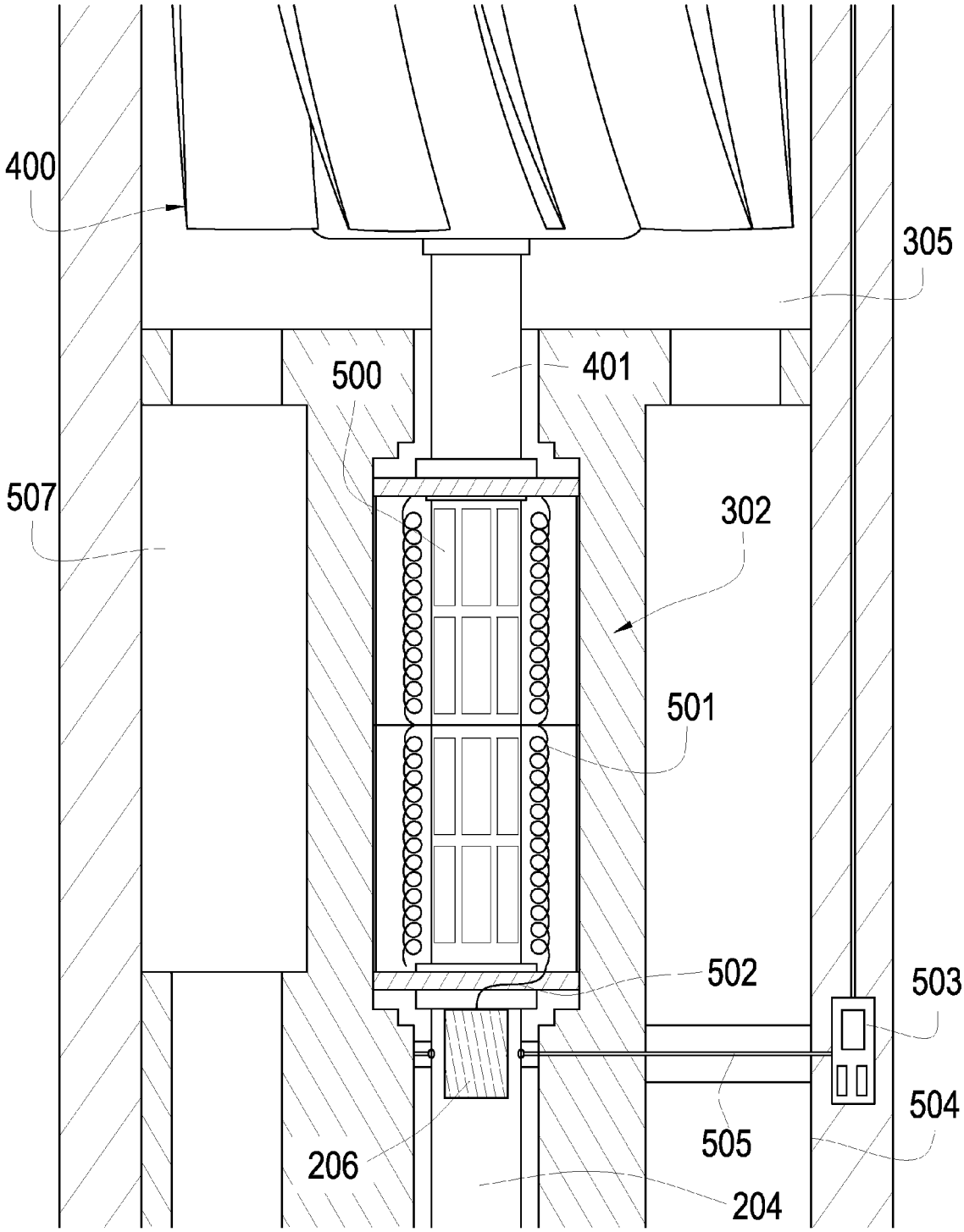
FIG. 5 is a cross-sectional diagram of an embodiment of a material driven transducer.

FIG. 5 illustrates a cross-section of a power source 302, more specifically, an electric generator. The transducer 206 may be in communication with the power source 302. The generator may comprise separate magnetic components 500 disposed along the outside of a rotor 401 which magnetically interacts with a coil 501 as it rotates, producing a current. The magnetic components 500 are preferably made of samarium cobalt due to its high Curie temperature and high resistance to demagnetization. The coil 501 may be in communication with a turbine 400. Drilling fluid may rotate the turbine 400, thereby rotating the rotor 501 and producing a current. The current may travel through a wire 502 connecting the coil 501 and the transducer 206, causing the transducer to expand. The transducer 206 may be in communication with surface and/or downhole control equipment through electrical circuitry 503 disposed within a bore wall 504. The transducer 206 may be connected to the electrical circuitry 503 through a coaxial cable 505. The circuitry 503 may be part of a closed-loop system and may also comprise sensors for monitoring various aspects of drilling. At least one fluid passageway 507 disposed in the tool string 100 may be adapted to direct the drilling fluid around the electric generator. In this embodiment, the transducer 206 may be a piezoelectric device. Voltage traveling from the coil 501 to the piezoelectric device may cause the device to expand, thereby displacing the jack element 204 into a formation. The power supply may be AC voltage such that the material driven transducer repeatedly expands and contracts, vibrating the jack element 204.

Figure 6:
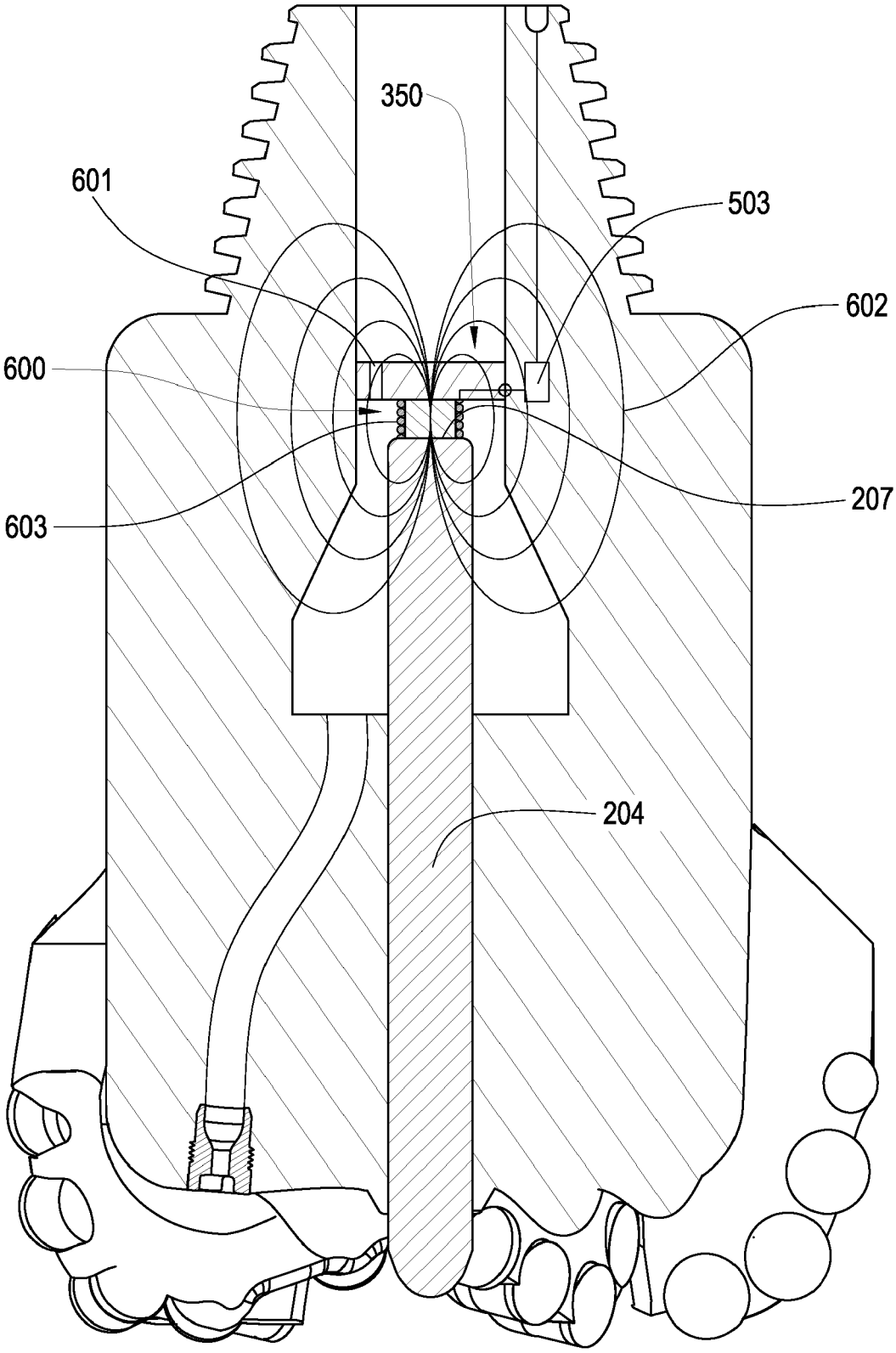
FIG. 6 is a cross-sectional diagram of another embodiment of a drill bit assembly.

In other embodiments, the transducer 206 may be a magnetostrictive device as shown in FIG. 6. A magnetostrictive device 600 may be positioned between the jack element 204 and a thrust bearing 350 fixed to the bore wall 504. The thrust bearing 350 may comprise at least one fluid passageway 601. The magnetostrictive device 600 may be adapted to produce a magnetic field 602 when the device 600 is compressed between the proximal end 207 of the jack element 204 and the thrust bearing 350. During a drilling operation, the jack element 204 may displace due to varying formation conditions downhole. The displacement of the jack element 204 may cause the magnetostrictive device 600 to compress. Coils 603 surrounding the device may receive the magnetic field 602 and produce an electric current. The coils 603 surrounding the device 600 may be in communication with control equipment located downhole and/or at the surface. The data collected may be analyzed by the control equipment and used to determine characteristics of the downhole formation such as, strain, stress, and/or compressive strength.

The magnetostrictive device 600 may also be adapted to receive a magnetic field 602 and thereby expand in order to displace the jack element 204. During a drilling operation, electric voltage may be sent from the control equipment through electrical circuitry 503 in communication with coils 603, the coils 603 producing a magnetic field 602. The magnetic field 602 sensed by the magnetostrictive device 600 may cause the device 600 to expand against the proximal end 207 of the jack element 204. This may be beneficial because the vibrations of the jack element 204 may more efficiently break up the downhole formation. The magnetostrictive device may comprise Terfenol-D or Galfenol. The device 600 may be rotationally isolated from the jack element 204.

Figure 7:
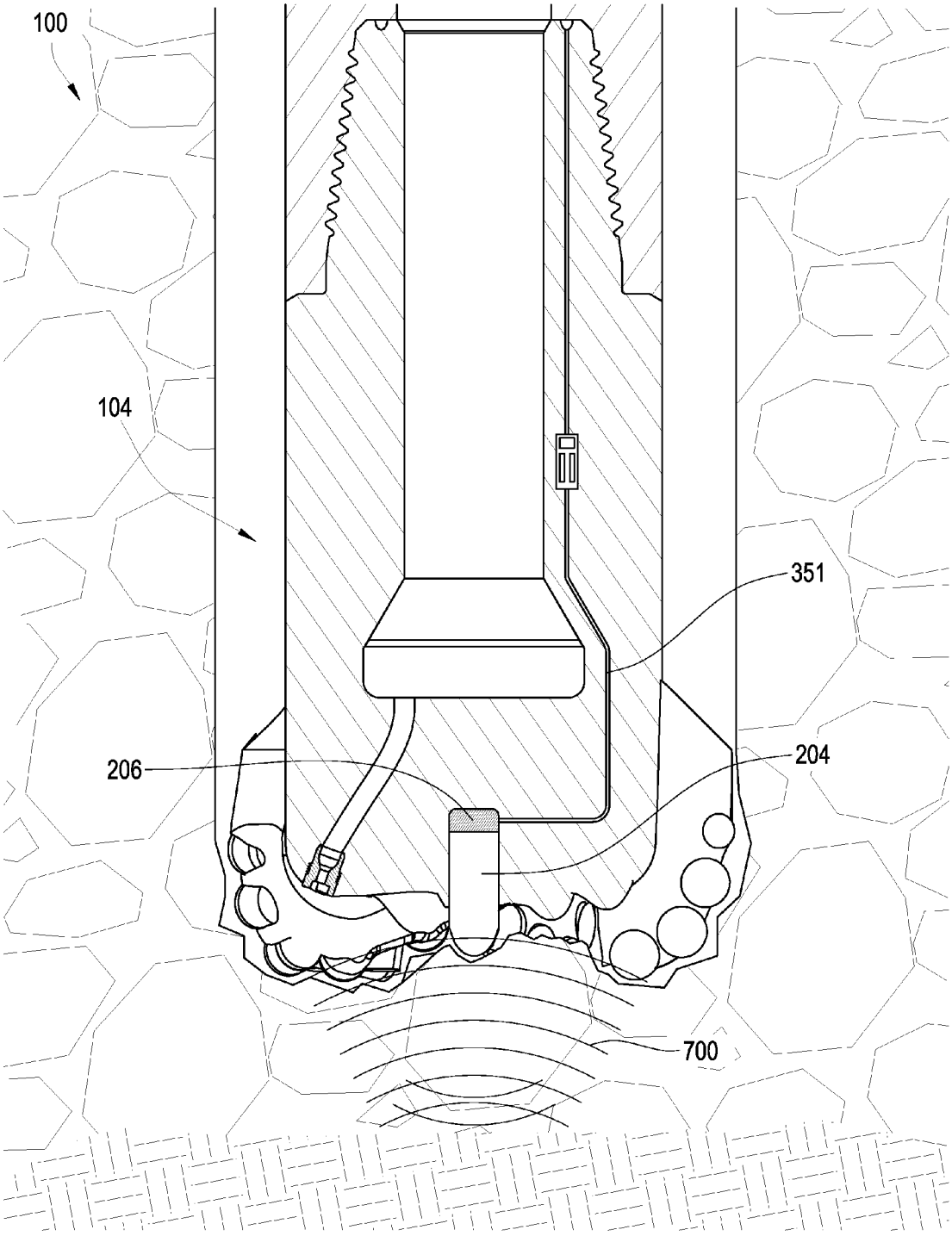
FIG. 7 is a cross-sectional diagram of another embodiment of a drill bit assembly.

FIG. 7 is a cross-sectional diagram of a transducer 206 in communication with the jack element 204. Further, the transducer 206 may be in communication with surface and/or downhole control equipment through an electrically conductive medium 351. The conductive medium 500 may be a coaxial cable, wire, twisted pair of wires, or a combination thereof. During a drilling operation, a power source may supply a voltage to the transducer 206 through the electrically conductive medium 351, causing the jack element to vibrate. The vibrations of the jack element 204 may produce an acoustic signal 700. The acoustic signal 700 may reverberate off a formation 105 and return back to the drill bit assembly 104. The returning signals may vibrate the jack element 204. These vibrations of the jack element 204 may compress the transducer 206 so that it produces an electric voltage. The voltage may be sent through the electrically conductive medium 351 to control equipment. It may be preferred that the acoustic signals 107 comprise multiple frequencies. Short frequencies may be useful for analyzing formations substantially close to the drill bit assembly 104. Low frequencies may be beneficial in analyzing formations farther from the drill bit assembly 104. Acoustic signals returned from close formations may be sensed by receivers located on the drill bit assembly 104 whereas low frequencies may be sensed by receivers located higher up on the tool string 100 or at the surface. In some embodiments, high and low frequencies are sensed at the some location on the drill string, such as on the bit.

Figure 8:
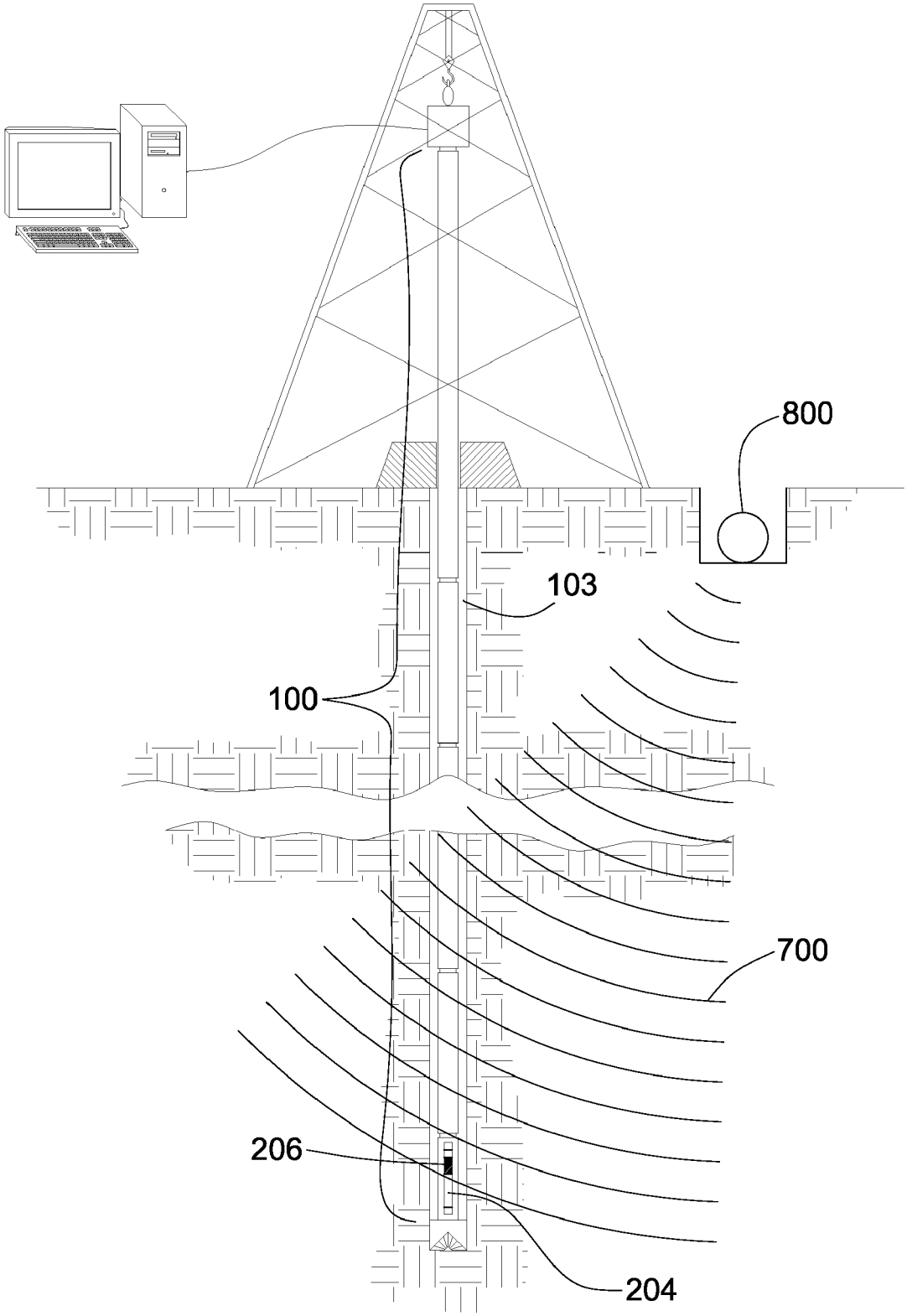
FIG. 8 is a perspective diagram of another embodiment of a tool string suspended in a well bore.

FIG. 8 is a perspective diagram of a tool string 100 suspended in a well bore 103. In this embodiment, vibrations may be transmitted to the transducer 206 through the jack element 204, the vibrations originating from acoustic signals 700 produced by a surface signal source 800. The signal source 800 may be a seismic source, a sonic source, an explosive, a compressed air gun or array, a vibrator, a sparker, or combinations thereof.

Figure 9:
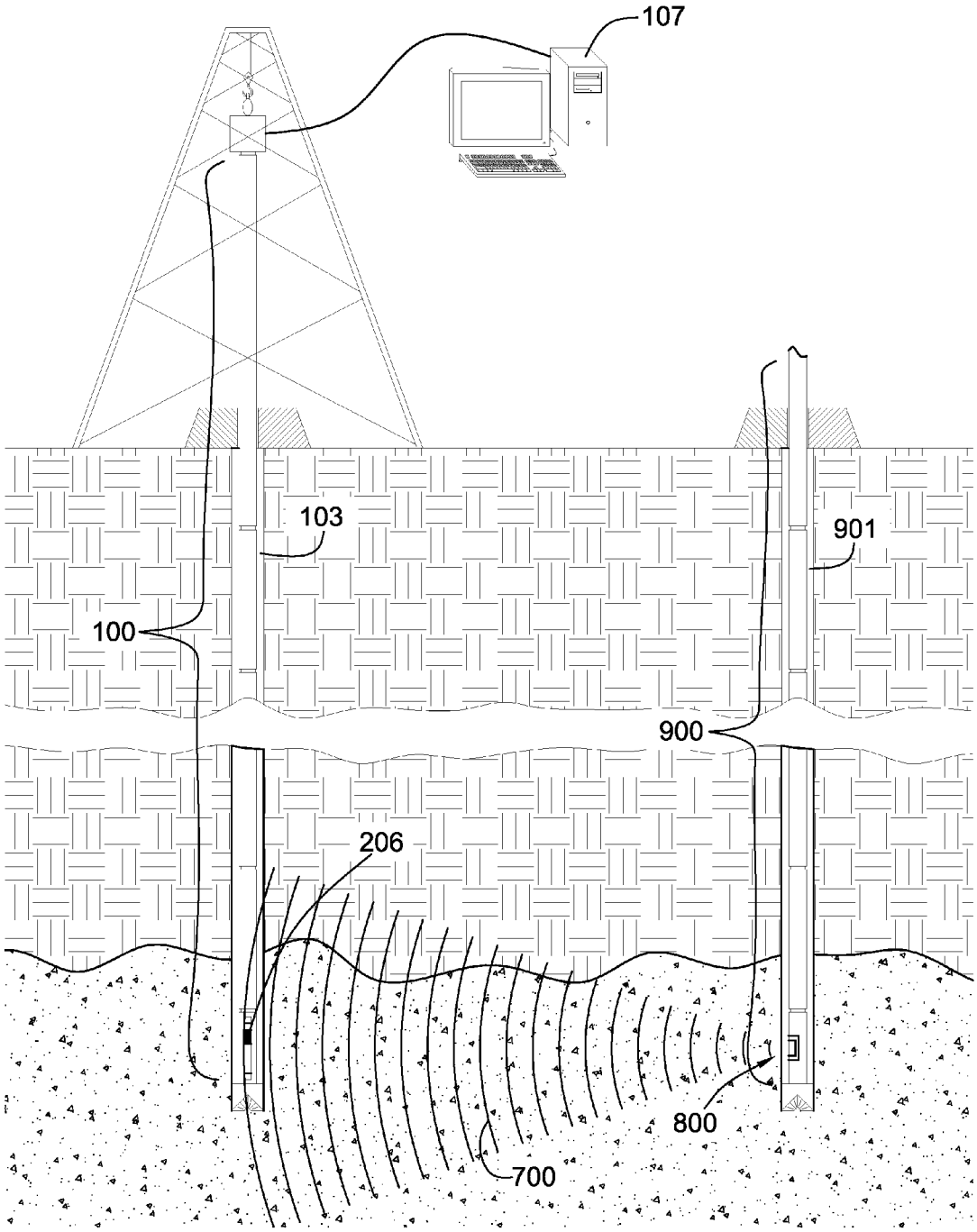
FIG. 9 is a perspective diagram of another embodiment of a tool string suspended in a well bore.

FIG. 9 is a diagram of another tool string 100 suspended in a well bore 103. In some embodiments, there may be a first tool string 100 and a second tool string 900 disposed in two separate well bores 103, 901. The signal source 800 may be a cross-well source and may be within a transmitting distance of a transducer 206. The jack element of the tool string 100 may vibrate upon reception of the acoustic signal 700 from the cross-well source, thereby exerting a force on the transducer 206 in communication with the jack element 204. The transducer 206 may be in communication with control equipment 107. The control equipment 107 may analyze the properties of the vibrations received by the jack transducer 206. Characteristics of a formation 105 may be determined based on these data and thereby adjustments to the drilling operation may be made.

Figure 10:
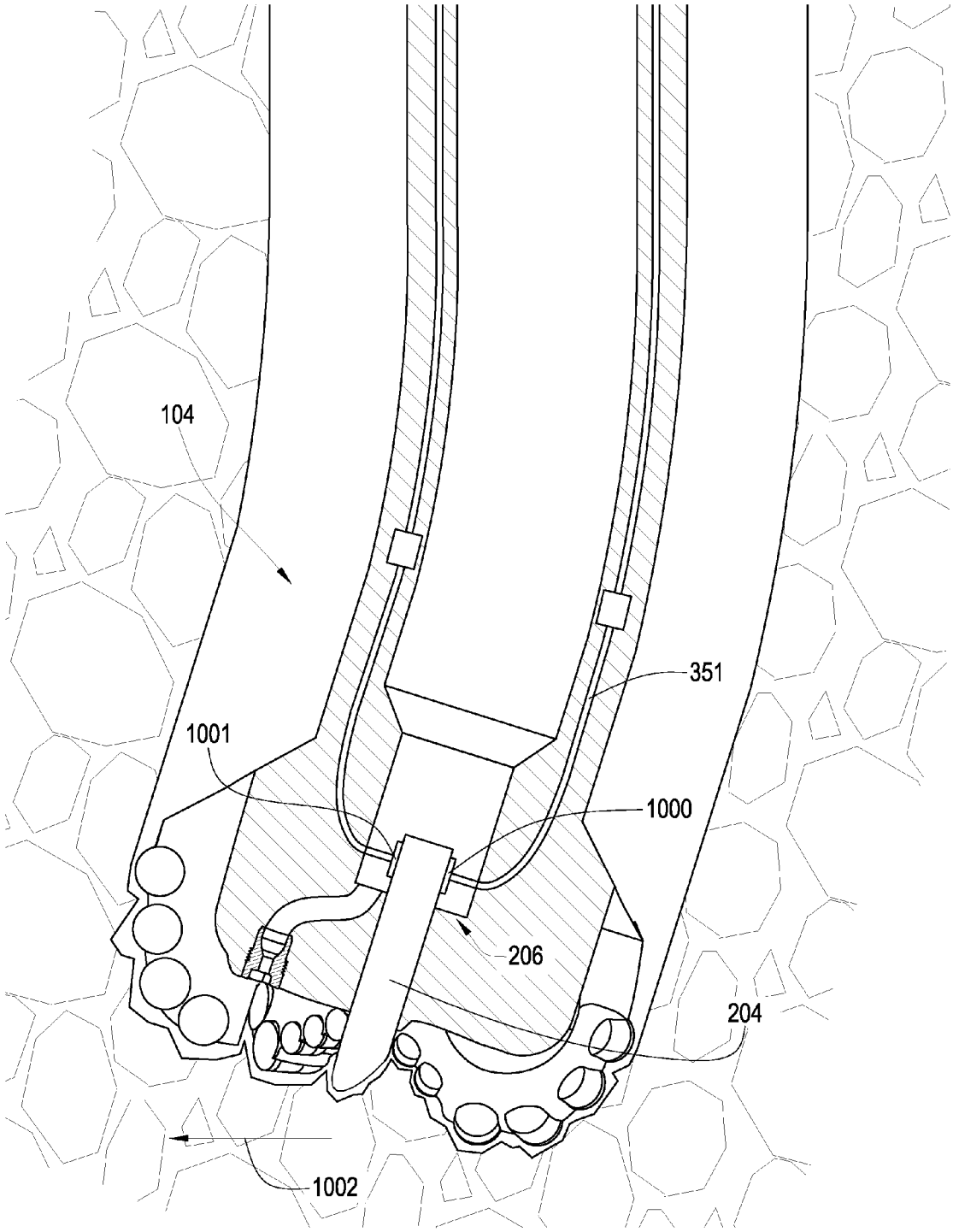
FIG. 10 is a cross-sectional diagram of another embodiment of a drill bit assembly.

A transducer device may be used in steering the tool string. FIG. 10 is a cross-sectional diagram of a drill bit assembly 104. At least one transducer 206 may be in communication with the jack element 204. In this embodiment, a first piezoelectric device 1000 may be positioned opposite a second piezoelectric device 1001 around the jack element 204. Each piezoelectric device 1000, 1001, may be connected with an electrically conductive medium 351 and may be in communication with surface and/or downhole control equipment. The control equipment may send voltage to one or both piezoelectric devices in order to steer the tool string 100. For example, to steer the tool string 100 in a given direction 1002, the first device 1000 opposite the desired direction 1002 may receive voltage from the control equipment so that as the device expands, it may force the jack element 204 in the desired direction 1002. During some drilling operations, the control equipment may send no voltage to either device 1000, 1001, in order to drill in a straight line.

Figure 11:
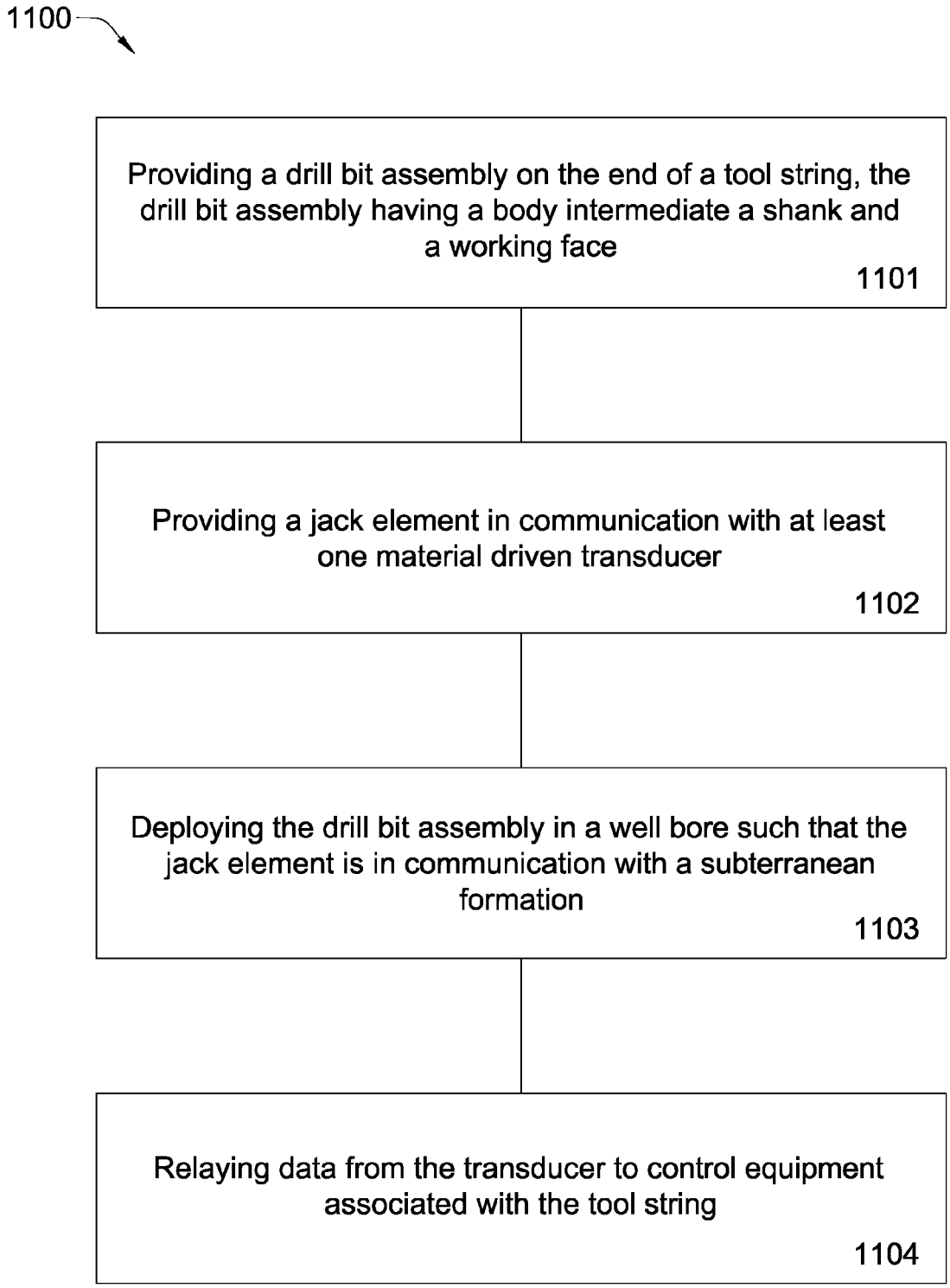
FIG. 11 is a diagram of an embodiment of a method for retrieving downhole data.

FIG. 11 shows a method 1100 having steps for retrieving downhole data. The method 1100 includes a step of providing 1101 a drill bit assembly on the end of a tool string, the drill bit assembly having a body intermediate a shank and a working face. The method 1100 also includes providing 1102 a jack element in communication with at least one material driven transducer. The material driven transducer may be a piezoelectric device or a magnetostrictive device. The method 1100 further includes deploying 1103 the drill bit assembly in a well bore such that the jack element is in communication with a subterranean formation. Finally, the method 1100 includes relaying 1104 data from the transducer to control equipment associated with the tool string. The method may further include a step of inducing at least one acoustic signal generated by the transducer and transmitted through the jack element into the formation. The acoustic signal may be received by acoustic receivers located at the drill bit assembly, tool string, or earth surface; the acoustic receivers being in communication with downhole and/or surface control equipment having a closed loop system. The control equipment may be in communication with the transducer through an electrically conductive medium connected to the drill bit assembly.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly, comprising:

a body between a shank and a working face;

the working face comprising at least one cutting element;

a jack element comprising a distal end protruding from the working face; and at least one transducer in communication with the jack element.

2. The assembly of claim 1, wherein the transducer further comprises a piezoelectric device.

3. The assembly of claim 2, wherein the transducer further comprises a material selected from the group that includes quartz, barium titanate, lead zirconate titanate, lead niobate, polyvinylidene fluoride, gallium orthophosphate, tourmaline, zinc oxide, aluminum nitride, and combinations thereof.

4. The assembly of claim 1, wherein the transducer comprises a magnetostrictive device.

5. The assembly of claim 4, wherein the transducer further comprises Terfenol-D or Galfenol.

6. The assembly of claim 4, wherein the transducer is rotationally isolated from the jack element.

7. The assembly of claim 1, wherein the transducer is positioned between a proximal end of the jack element and the shank.

8. The assembly of claim 1, wherein the transducer is disposed on the jack element.

9. The assembly of claim 1, wherein a strain gauge is in communication with the jack element.

10. The assembly of claim 1, wherein the distal end of the jack element comprises an asymmetric geometry.

11. The assembly of claim 1, wherein the transducer is in communication with a power source, the power source being and is adapted to vibrate the jack element.

12. The assembly of claim 11, wherein the power source supplies AC power to the transducer.

13. A method for retrieving downhole data comprising:

providing a drill bit assembly on the end of a tool string, the drill bit assembly having a body between a shank and a working face;

providing a jack element comprising a distal end protruding from the working face, the jack element being in communication with at least one transducer;

deploying the drill bit assembly in a well bore such that the jack element is in contact with a subterranean formation; and relaying vibration data from the formation transmitted through the jack element to the downhole transducer.

14. The method of claim 13, wherein the transducer further comprises a piezoelectric device.

15. The method of claim 13, wherein the transducer further comprises a magnetostrictive device.

16. The method of claim 13, further comprising:

generating an acoustic signal with the transducer;

transmitting the acoustic signal through the jack element and into the formation.

17. The method of claim 16, wherein the at least one acoustic signal comprises multiple frequencies.

18. The method of claim 16, wherein the acoustic signal is received by an acoustic receivers located at one of the drill bit assembly, the tool string, and at an earth surface.

19. The method of claim 18, wherein the acoustic receivers are in communication with at least one of a downhole control equipment and a surface control equipment.

20. The method of claim 19 wherein each of the downhole control equipment and the surface control equipment comprises a closed loop system.

21. The method of claim 13, further comprising:

generating an acoustic signal that is transmitted into the formation;

receiving the acoustic signal at the jack element in contact with the formation and transmitting the acoustic signal through the jack element to the transducer;

converting the acoustic signal at the transducer to an electric signal representative of the acoustic signal;

transmitting the electric signal to control equipment.

22. The method of claim 21, further comprising:

generating the acoustic signal with the transducer;

transmitting the acoustic signal through the jack element and into the formation.

23. A drill bit comprising:

a body between a working face and a shank configured to be coupled to a tool string, the working face including at least one cutting element; and, at least one transducer coupled to a jack element, the transducer configured to cause the jack element to extend and to retract from the working face.

24. The drill bit of claim 23, further comprising a power source configured to apply power to the transducer.

25. The drill bit of claim 24, wherein the power source comprises an electric generator coupled to a turbine.

26. The drill bit of claim 23, wherein the transducer further comprises a piezoelectric device.

27. The drill bit of claim 26, wherein the transducer further comprises a material selected from the group that includes quartz, barium titanate, lead zirconate titanate, lead niobate, polyvinylidene fluoride, gallium orthophosphate, tourmaline, zinc oxide, aluminum nitride, and combinations thereof.

28. The drill bit of claim 23, wherein the transducer comprises a magnetostrictive device.

29. The drill bit of claim 28, wherein the transducer further comprises Terfenol-D or Galfenol.

* * * * *